US010934130B2

(12) United States Patent
Krishnamurthy et al.

(10) Patent No.: US 10,934,130 B2
(45) Date of Patent: Mar. 2, 2021

(54) ELEVATOR CONTROL SYSTEM

(71) Applicant: OTIS ELEVATOR COMPANY, Farmington, CT (US)

(72) Inventors: Shashank Krishnamurthy, Glastonbury, CT (US); Jose Miguel Pasini, Avon, CT (US); David Ginsberg, Granby, CT (US); Arthur Hsu, South Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 515 days.

(21) Appl. No.: 15/754,066

(22) PCT Filed: Aug. 24, 2016

(86) PCT No.: PCT/US2016/048405
§ 371 (c)(1),
(2) Date: Feb. 21, 2018

(87) PCT Pub. No.: WO2017/035237
PCT Pub. Date: Mar. 2, 2017

(65) Prior Publication Data

US 2018/0186595 A1 Jul. 5, 2018

Related U.S. Application Data

(60) Provisional application No. 62/209,143, filed on Aug. 24, 2015.

(51) Int. Cl.

| | |
|---|---|
| ***B66B 1/30*** | (2006.01) |
| ***B66B 11/04*** | (2006.01) |
| ***B66B 1/24*** | (2006.01) |
| ***B66B 9/02*** | (2006.01) |
| ***B66B 1/34*** | (2006.01) |

(Continued)

(52) U.S. Cl.
CPC ..... *B66B 1/30* (2013.01); *B66B 1/2458* (2013.01); *B66B 1/302* (2013.01); *B66B 1/3476* (2013.01);
(Continued)

(58) Field of Classification Search
CPC ..... B66B 1/30; B66B 1/2458; B66B 9/02; B66B 1/302; B66B 1/3476; B66B 3/002;
(Continued)

(56) References Cited

U.S. PATENT DOCUMENTS 4,402,387 A * 9/1983 Tsuji ..... B66B 1/285 187/293
4,838,384 A 6/1989 Thangavelu
(Continued)

FOREIGN PATENT DOCUMENTS

CN 102085985 A 6/2011
CN 103159093 A 6/2013
(Continued)

OTHER PUBLICATIONS

Chinese Office Action for Application No. 201680049016.9 dated Sep. 25, 2019; 10 pages.
(Continued)

*Primary Examiner* — Jeffrey Donels
(74) *Attorney, Agent, or Firm* — Cantor Colburn LLP

(57) ABSTRACT

An elevator system includes a first elevator car (28) constructed and arranged to move in a first lane (30, 32, 34) and a first propulsion system (40) constructed and arranged to propel the first elevator. An electronic processor of the elevator system is configured to selectively control power delivered to the first propulsion system (40). The electronic processor includes a software-based power estimator configured to receive a first weight signal and a nm trajectory signal for calculating a power estimate and comparing the
(Continued)

power estimate to a maximum power allowance. The electronic processor is configured to output an automated command signal if the power estimate exceeds the maximum power allowance.

4 Claims, 6 Drawing Sheets

(51) Int. Cl.
*B66B 3/00* (2006.01)
*B66B 9/00* (2006.01)

(52) U.S. Cl.
CPC ..... *B66B 3/002* (2013.01); *B66B 9/003* (2013.01); *B66B 9/02* (2013.01); *B66B 9/025* (2013.01); *B66B 11/0407* (2013.01); *B66B 11/0446* (2013.01); *B66B 1/2466* (2013.01); *B66B 2201/00* (2013.01); *B66B 2201/216* (2013.01); *B66B 2201/226* (2013.01)

(58) Field of Classification Search
CPC ..... B66B 9/003; B66B 9/025; B66B 11/0446; B66B 11/0407; B66B 2201/216; B66B 2201/226; B66B 2201/00; B66B 1/2466
See application file for complete search history.

(56) References Cited

U.S. PATENT DOCUMENTS

| | | | | |
|---|---|---|---|---|
| 2005/0006183 | A1 | 1/2005 | Smith et al. | |
| 2007/0084673 | A1 | 4/2007 | Smith et al. | |
| 2007/0119660 | A1 | 5/2007 | Bahjat et al. | |
| 2008/0006172 | A1 | 1/2008 | Thornton | |
| 2008/0041666 | A1 | 2/2008 | Siikonen et al. | |
| 2008/0308361 | A1* | 12/2008 | Nikovski | B66B 1/2458 187/385 |
| 2014/0360817 | A1* | 12/2014 | Putkinen | B66B 1/2458 187/247 |
| 2016/0145075 | A1* | 5/2016 | Hanninen | B66B 1/302 187/289 |

FOREIGN PATENT DOCUMENTS

| | | | |
|---|---|---|---|
| CN | 103508280 | A | 1/2014 |
| CN | 103803362 | A | 5/2014 |
| CN | 103863912 | A | 6/2014 |
| CN | 104276464 | A | 1/2015 |
| EP | 2500309 | A1 | 9/2012 |
| JP | 2005335893 | A | 12/2005 |
| JP | 5047246 | B2 | 10/2012 |
| WO | 2006120283 | A1 | 11/2006 |

OTHER PUBLICATIONS

International Search Report for application No. PCT/US2016/048405 dated Dec. 13, 2016; 6 pages.
Written Opinion of the International Searching Authority for application No. PCT/US2016/048405 dated Dec. 13, 2016; 7 pages.
Zhang, Jinglong et al. "Energy-saving-oriented group-elevator dispatching strategy for multitraffic patterns", Sage Journals, URL:<http://journals.sagepub.com/doi/pdf/10.1177/0143624414526723>; 6 pages.

* cited by examiner

ELEVATOR CONTROL SYSTEM

CROSS-REFERENCES TO RELATED APPLICATIONS

This patent application is a US National Stage Application of PCT/US2016/048405, filed Aug. 24, 2016, which claims the priority of U.S. Provisional Application No. 62/209,143, filed Aug. 24, 2015, each of which are incorporated herein by reference in their entirety.

BACKGROUND

The present disclosure relates to elevator systems, and more particularly to an elevator control system configured to govern power consumption.

Self-propelled elevator systems (as one example), also referred to as ropeless elevator systems, are useful in certain applications (e.g., high rise buildings) where the mass of the ropes for a roped system is prohibitive and there is a desire for multiple elevator cars to travel in a single lane. There exist self-propelled elevator systems in which a first lane is designated for upward traveling elevator cars and a second lane is designated for downward traveling elevator cars. Existing self-propelled elevator systems may operate more than one elevator car in a lane, and have elevator cars traveling in different directions in a single lane. Linear propulsion motors aligned along each elevator hoistway may draw substantial power at regions where any one car is located. Control of power distribution and governing peak power consumption is beneficial.

SUMMARY

A method of governing elevator power according to one, non-limiting, embodiment of the present disclosure includes calculating a power estimate for the elevator car by the electronic processor based on a run trajectory; comparing the power estimate to a pre-programmed maximum power allowance; and initializing an automated action by the electronic processor if the power estimate exceeds the maximum power allowance.

Additionally to the foregoing embodiment, the method includes inputting an elevator car weight for calculating the power estimate.

In the alternative or additionally thereto, in the foregoing embodiment, the automated action comprises slowing down the maximum speed of the elevator car.

In the alternative or additionally thereto, in the foregoing embodiment, the automated action comprises delaying the start of the elevator car of a plurality of elevator cars.

In the alternative or additionally thereto, in the foregoing embodiment, the automated action comprises lowering at least one elevator car of a plurality of elevator cars to recover power through regeneration.

In the alternative or additionally thereto, in the foregoing embodiment, the maximum power allowance is on a per motor module basis and the automated action comprises preventing a plurality of cars from stopping too closely thereby positioning the plurality of cars on different motor modules.

In the alternative or additionally thereto, in the foregoing embodiment, the method includes establishing traffic patterns in time and space; and utilizing the traffic patterns to anticipate power demand distribution, and wherein the automated action comprises placing the car so power demand is not concentrated in the time and space.

In the alternative or additionally thereto, in the foregoing embodiment, the method includes entry of the run trajectory by an occupant; and allocating the occupant to a specific elevator car of a plurality of elevator cars based on the run trajectory and the power estimate for each one of the plurality of elevator cars.

In the alternative or additionally thereto, in the foregoing embodiment, the automated action comprises slowing down the maximum speed of at least one elevator car of a plurality of elevator cars A ropeless elevator system according to another, non-limiting, embodiment includes a first elevator car constructed and arranged to move in a first lane; a first plurality of motor modules distributed along the first lane and constructed and arranged to propel the first elevator car; an electronic processor configured to selectively control power delivered to each one of the first plurality of motor modules, the electronic processor including a software-based power estimator configured to receive a weight signal and a run trajectory signal for calculating a power estimate and comparing the power estimate to a maximum power allowance, and wherein the electronic processor is configured to output an automated command signal if the power estimate exceeds the maximum power allowance.

Additionally to the foregoing embodiment, the ropeless elevator system includes a load sensor carried by the elevator car and configured to output the weight signal.

In the alternative or additionally thereto, in the foregoing embodiment, the ropeless elevator system includes an occupant control display carried by the elevator car and configured to receive an occupant initiated command and output the associated run trajectory signal to the electronic processor.

In the alternative or additionally thereto, in the foregoing embodiment, the automated command signal is selectively outputted to the first plurality of motor modules for slowing down a maximum speed of the first elevator car.

In the alternative or additionally thereto, in the foregoing embodiment, the ropeless elevator system includes a second elevator car configured to be controlled by the automated command signal.

In the alternative or additionally thereto, in the foregoing embodiment, the second elevator car is located in a second lane and propelled by a second plurality of motor modules distributed along the second lane, and the automated command signal is selectively outputted to the second plurality of motor modules for lowering the second elevator car for power regeneration.

In the alternative or additionally thereto, in the foregoing embodiment, the ropeless elevator system includes a second elevator car constructed and arranged to move in a second lane; and a second plurality of motor modules distributed along the second lane and constructed and arranged to propel the second elevator car, and wherein the automated command signal is selectively outputted to the second plurality of motor modules for lowering the second elevator car for power regeneration if the weight signal is indicative of the second elevator car being empty.

In the alternative or additionally thereto, in the foregoing embodiment, the second elevator car is located in the first lane and propelled by the first plurality of motor modules, and the automated command signal is selectively outputted to the first plurality of motor modules for preventing the first and second elevator cars from stopping too closely thereby positioning the first and second elevator cars at different modules of the first plurality of modules.

In the alternative or additionally thereto, in the foregoing embodiment, the automated command signal delays the start of the run trajectory.

An elevator system according to another, non-limiting, embodiment includes a first elevator car constructed and arranged to move in a first lane; a first propulsion system constructed and arranged to propel the first elevator car; a first load sensor carried by the first elevator car; and an electronic processor configured to control power delivered to the first propulsion system, the electronic processor including a software-based power estimator configured to receive a first weight signal from the first load sensor and a run trajectory signal for calculating a power estimate and comparing the power estimate to a maximum power allowance, and wherein the electronic processor is configured to output an automated command signal if the power estimate exceeds the maximum power allowance.

Additionally to the foregoing embodiment, the elevator system includes a second elevator car constructed and arranged to move in a second lane; a second load sensor carried by the second elevator car; and a second propulsion system constructed and arranged to propel the second elevator car, wherein the software-based power estimator is configured to receive a second weight signal from the second load sensor, and the automated command signal is selectively outputted to the second propulsion system for lowering the second elevator car for power regeneration if the second weight signal is indicative of the second elevator car being empty.

In the alternative or additionally thereto, in the foregoing embodiment, the first propulsion system is a screw-motor-based propulsion system.

In the alternative or additionally thereto, in the foregoing embodiment, the first propulsion system is a linear motor system.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
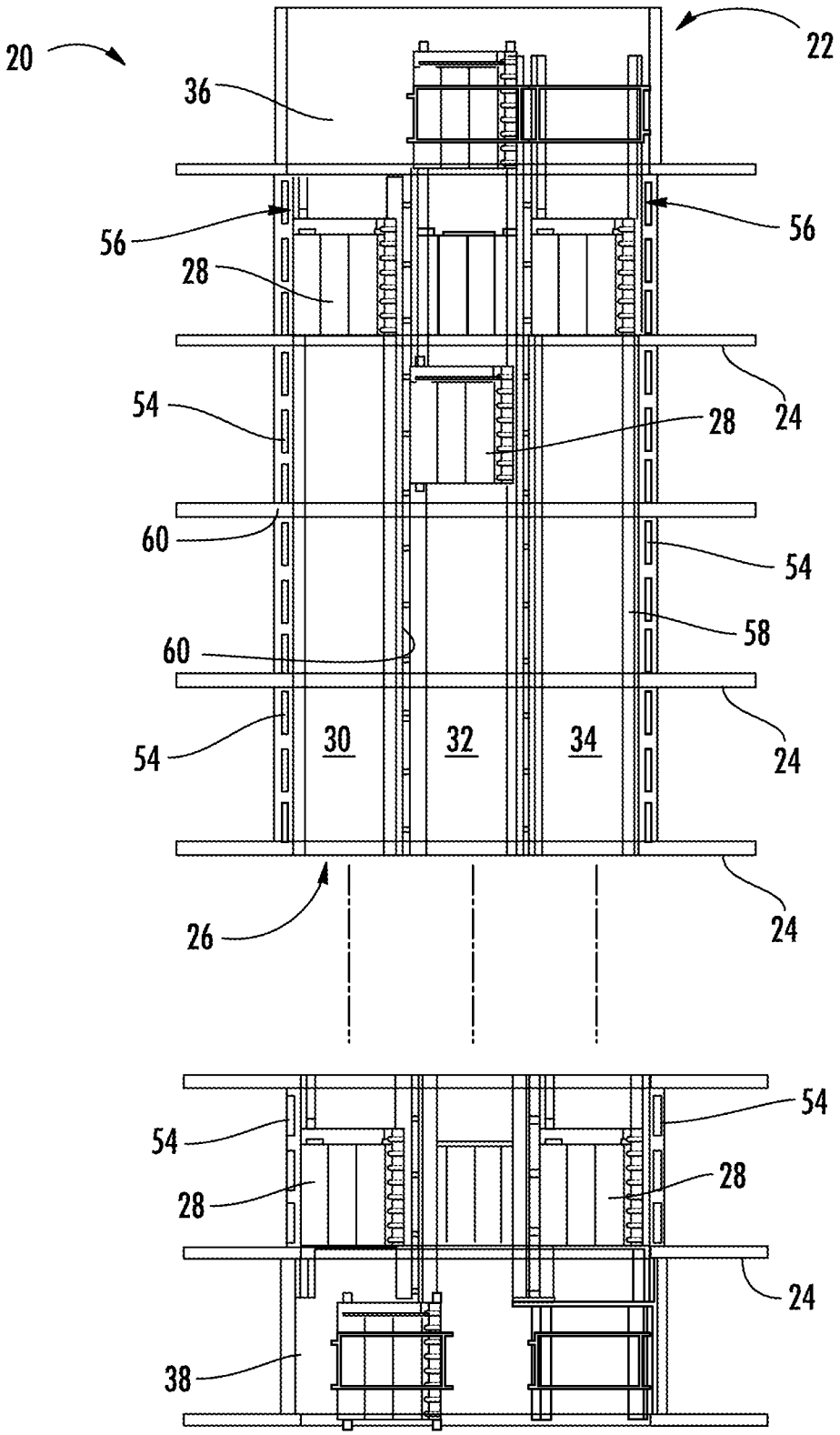
FIG. 1 depicts a multicar elevator system in an exemplary embodiment.

FIG. 1 depicts a self-propelled or ropeless elevator system 20 in an exemplary embodiment that may be used in a structure or building 22 having multiple levels or floors 24. Elevator system 20 includes a hoistway 26 defined by boundaries carried by the structure 22, and at least one car 28 adapted to travel in the hoistway 26. The hoistway 26 may include, for example, three lanes 30, 32, 34 with any number of cars 28 traveling in any one lane and in any number of travel directions (e.g., up and down). For example and as illustrated, the cars 28 in lanes 30, 34, may travel in an up direction and the cars 28 in lane 32 may travel in a down direction. It is further contemplated and understood, that an elevator system 20 which is ropeless is but one example of elevator systems that may benefit from the power management aspects of the present disclosure.

Above the top floor 24 may be an upper transfer station 36 that facilitates horizontal motion to elevator cars 28 for moving the cars between lanes 30, 32, 34. Below the first floor 24 may be a lower transfer station 38 that facilitates horizontal motion to elevator cars 28 for moving the cars between lanes 30, 32, 34. It is understood that the upper and lower transfer stations 36, 38 may be respectively located at the top and first floors 24 rather than above and below the top and first floors, or may be located at any intermediate floor. Yet further, the elevator system 20 may include one or more intermediate transfer stations (not illustrated) located vertically between and similar to the upper and lower transfer stations 36, 38.

Figure 2:
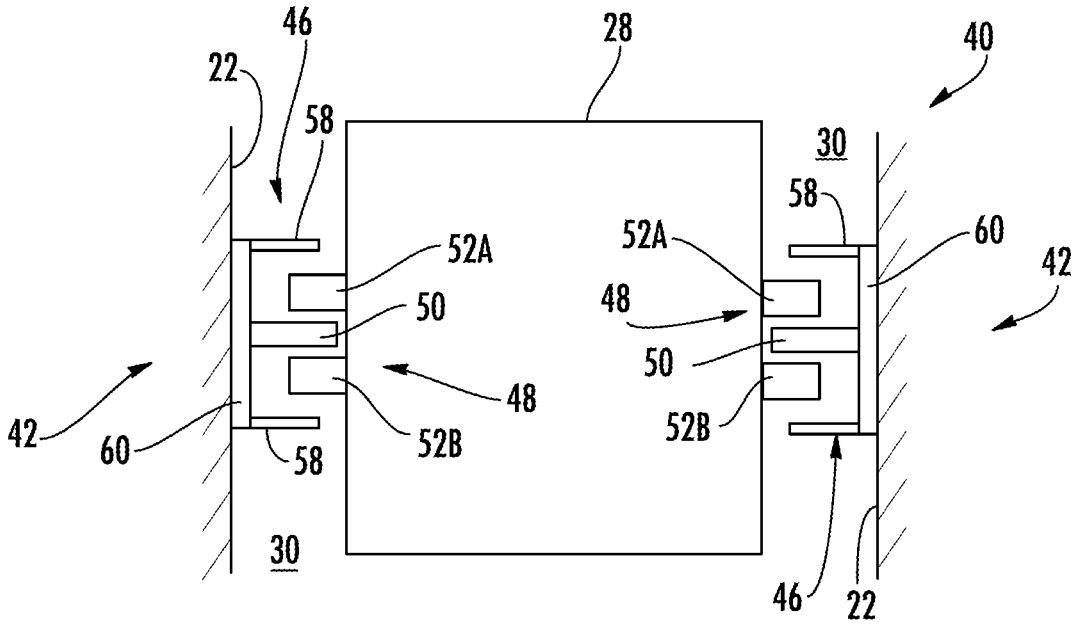
FIG. 2 is a top down view of a car and portions of a propulsion system in an exemplary embodiment.

Referring to FIGS. 1 and 2, the cars 28 are propelled using a propulsion system 40 such as a linear propulsion system. The propulsion system 40 may include two linear, magnetic, propulsion motors 42 that may be generally positioned on opposite sides of the elevator cars 28, and a control system 44 (see FIG. 3). Each motor 42 may include a fixed primary portion 46 generally mounted to the building 22, and a moving secondary portion 48 mounted to the elevator car 28. More specifically, the primary portions 46 may be located within the lanes 30, 32, 34 on walls or sides of the building 22 generally not associated with an elevator door.

Each primary portion 46 includes a plurality of windings or coils 50 (i.e. phase windings) that generally form a row extending longitudinally along and projecting laterally into each of the lanes 30, 32, 34. Each secondary portion 48 may include two rows of opposing permanent magnets 52A, 52B mounted to each car 28. The plurality of coils 50 of the primary portion 46 are generally located between and spaced from the opposing rows of permanent magnets 52A, 52B. It is contemplated and understood that any number of secondary portions 48 may be mounted to the car 28, and any number of primary portions 46 may be associated with the secondary portions 48 in any number of configurations. It is further understood that each lane may be associated with only one linear propulsion motor 42 or three or more motors 42. Yet further, the primary and secondary portions 46, 48 may be interchanged.

The secondary portion 48 operatively engages with the primary portion 46 to support and drive the elevators cars 28 within the lanes 30, 32, 34. Primary portion 46 is supplied with drive signals from one or more drives 54 of the control system 44 to control movement of elevator cars 28 in their respective lanes through the linear, permanent magnet motor system 40. The secondary portion 48 operatively connects with and electromagnetically operates with the primary portion 46 to be driven by the signals and electrical power. The driven secondary portion 48 enables the elevator cars 28 to move along the primary portion 46 and thus move within a lane 30, 32, 34.

The primary portion 46 may be formed from a plurality of motor segments or modules 56, with each module associated with a drive 54 of the control system 44. Although not shown, the central lane 30 (see FIG. 1) also includes a drive for each module 56 of the primary portion 46 that is within the lane 30. Those with ordinary skill in the art will appreciate that although a drive 54 is provided for each motor module 56 of the primary portion 46 (one-to-one) other configurations may be used without departing from the scope of this disclosure.

Figure 3:
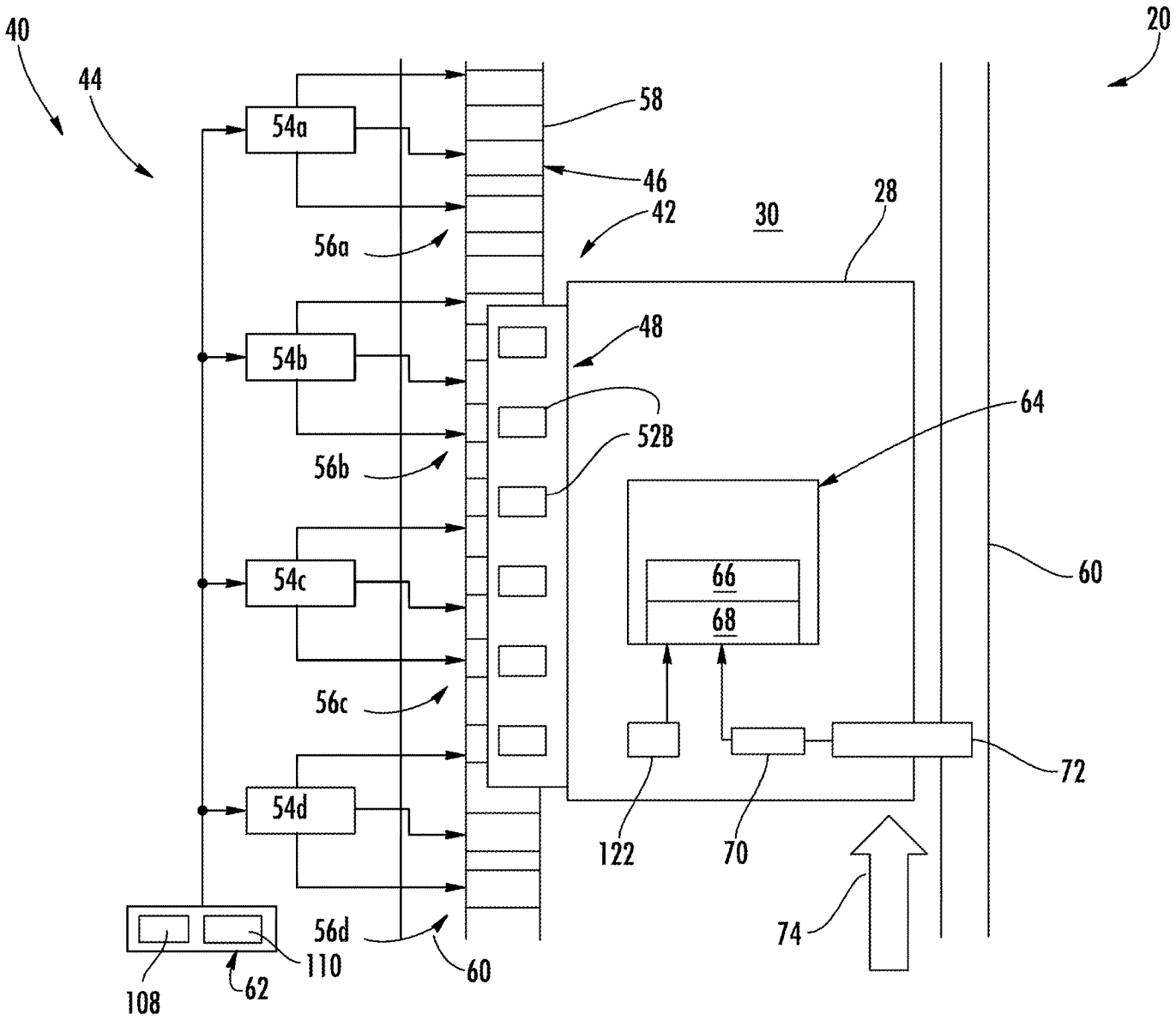
FIG. 3 is a schematic of the propulsion system.

Referring to FIGS. 2 and 3, a view of the elevator system 20 including the elevator car 28 that travels in lane 30 is shown. The elevator car 28 is guided by one or more guide rails 58 extending along the length of lane 30, where the guide rails 58 may be affixed to a structural member 60 that may also support the coils 52A, 52B of the primary portion 46. The primary portion 46 may be mounted to the guide rail 58, incorporated into the guide rail 58, or may be located apart from guide rail 54 on structural member 60 (as shown). The primary portion 46 serves as a stator of a permanent magnet synchronous linear motor to impart force to elevator car 28. Coils 50 of motor modules 56 (four illustrated and identified as 56*a*, 56*b*, 56*c*, and 56*d*) may be arranged in three phases, as is known in the electric motor art. One or more primary portions 46 may be mounted in the lane 30, to co-act with permanent magnets 52A, 52B mounted to the elevator car 28.

Each of the motor modules 56*a*, 56*b*, 56*c*, 56*d* may have a corresponding or associated drive 54*a*, 54*b*, 54*c*, 54*d* of the control system 40. A system controller 62 provides drive signals to the motor segments 56*a*, 56*b*, 56*c*, 56*d* via respective drives 54*a*, 54*b*, 54*c*, 54*d* to control motion of the elevator car 28. The system controller 62 may be implemented using a microprocessor executing a computer program stored on a storage medium to perform the operations described herein. Alternatively, the system controller 62 may be implemented in hardware (e.g., ASIC, FPGA) or in a combination of hardware/software. The system controller 62 may include power circuitry (e.g., an inverter or drive) to power the primary portion 46 of the linear motor 42. Although a single system controller 62 is depicted, it will be understood by those of ordinary skill in the art that a plurality of system controllers may be used. For example, a single system controller may be provided to control the operation of a group of motor segments over a relatively short distance, and in some embodiments a single system controller may be provided for each drive or group of drives, with the system controllers in communication with each other.

In some exemplary embodiments, as shown in FIG. 3, the elevator car 28 may include an on-board controller 64 with one or more transceivers 66 and a processor, or CPU, 68. The on-board controller 64 and the system controller 62 collectively form the control system 44 where computational processing may be shifted between the on-board controller 64 and the system controller 62. In some exemplary embodiments, the processor 68 of on-board controller 64 is configured to monitor one or more sensors and to communicate with one or more system controllers 62 via the transceivers 66. In some exemplary embodiments, to ensure reliable communication, elevator car 28 may include at least two transceivers 66 configured for redundancy of communication. The transceivers 66 can be set to operate at different frequencies, or communication channels, to minimize interference and to provide full duplex communication between the elevator car 28 and the one or more system controllers 62. The on-board controller 64 may interface with a load sensor 70 to detect an elevator load on a brake 72. The brake 72 may engage with the structural member 60, the guide rail 58, or other structure in the lane 30. Although the present example depicts only a single load sensor 70 and brake 72, the elevator car 28 can include multiple load sensors 70 and brakes 72.

In order to drive the elevator car 28, one or more motor modules 56*a*, 56*b*, 56*c*, 56*d* may be configured to overlap the secondary portion 48 secured to the elevator car 28 at any given point in time. For example and as illustrated in FIG. 3, motor module 56*d* partially overlaps the secondary portion 48 (e.g., about 33% overlap of the module), motor module 56*c* fully overlaps the secondary portion 48 (100% overlap of the module), and motor module 56*d* partially overlaps the secondary portion 48 (e.g., about 66% overlap of the module). There is no depicted overlap between motor segment 56*a* and the secondary portion 48. In some embodiments, the control system 44 (i.e., system controller 62 and on-board controller 64) is operable to apply an electrical current to at least one of the motor modules 56*b*, 56*c*, 56*d* that overlaps the secondary portion 48. The system controller 62 may control the electrical current on one or more of the drives 54*a*, 54*b*, 54*c*, 54*d* while receiving data from the on-board controller 64 via transceiver 66 based on load sensor 70. The electrical current may induce an upward thrust force (see arrow 74) to the elevator car 28 by injecting a constant current, thus propelling the elevator car 28 within the lane 30. The thrust produced by the propulsion system 40 is dependent, in part, on the amount of overlap between the primary portion 46 with the secondary portion 48. The peak thrust is obtained when there is maximum overlap of the primary portion 46 and the secondary portion 48.

Figure 4:
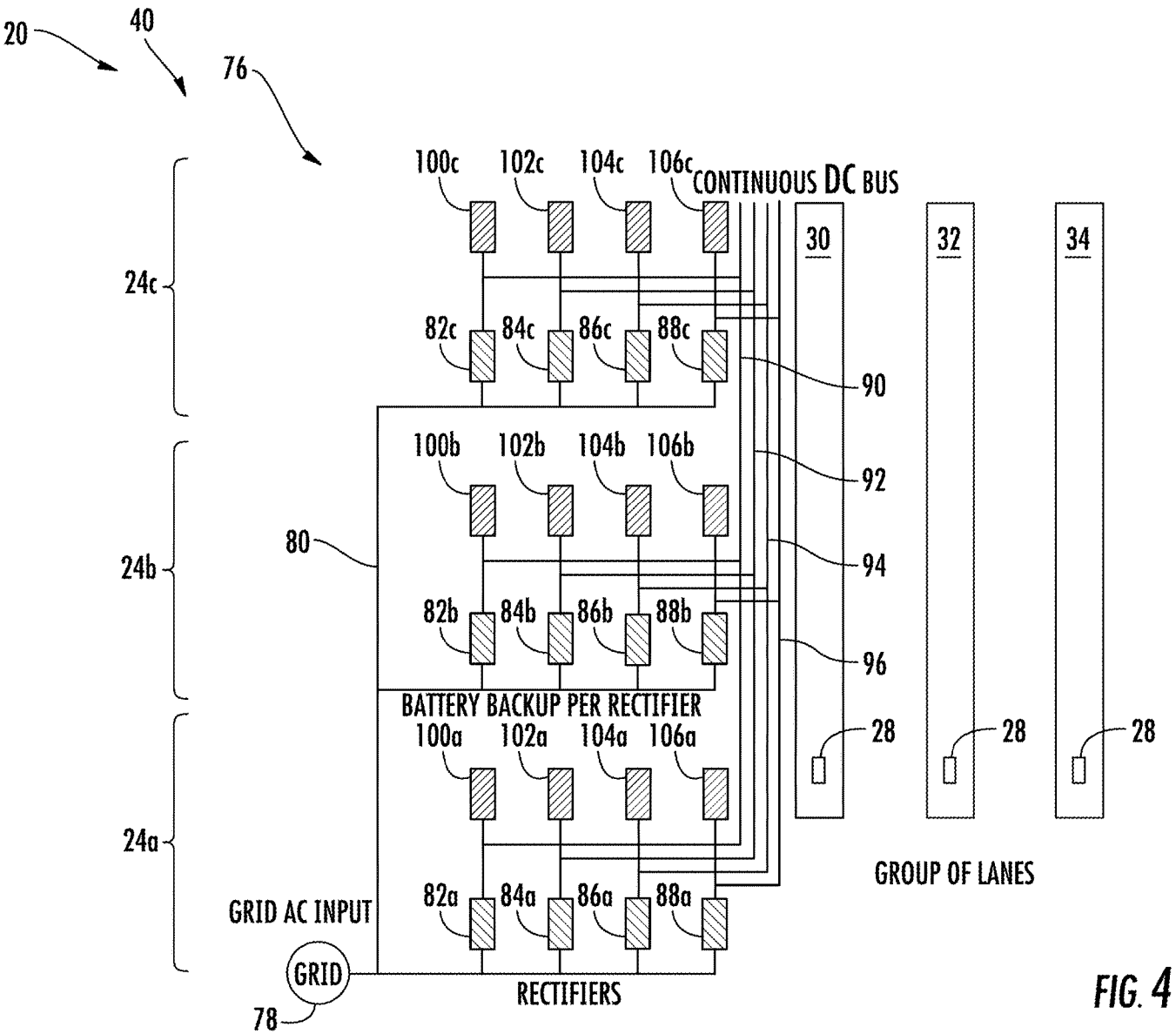
FIG. 4 is a schematic of a power distribution system of the propulsion system.

Referring to FIG. 4, a power distribution system 76 of the propulsion system 40 is configured to supply and distribute electrical power to the motors 42 thus enabling propulsion of the elevator cars 28 within the lanes 30, 32, 34. In typical building power distribution systems, alternating current (AC) power from the grid is fed to various loads throughout the building using an AC feeder distribution. The loads are localized and this approach provides power directly and efficiently to the various loads. For multicar elevator systems, individual elevator cars are distributed throughout the building (and within the lanes) based on the dispatching and load patterns, because of this, a power distribution scheme is needed to efficiently provide power to the various elevator cars 28. The power distribution system 76 may be configured to provide continuous direct current (DC) power to propel every car 28 in the multicar elevator system 20. Each lane 30, 32, 34 may facilitate the power distribution system 76 enabling the supply of DC power to propel each and every car 28 within the building 22.

AC power from a grid 78 may be provided through power lines 80 to various building floors 24 (i.e., three illustrated and identified as 24*a*, 24*b*, and 24*c*) and converted to DC power through rectifiers. As used herein, rectifier refers to any device configured to convert AC power to DC power. Thus, although the term rectifier is used throughout this description, those of ordinary skill in the art will appreciate that other configurations and/or device may be used without departing from the scope of the present disclosure. Specifically, the term rectifier, as used herein, encompasses any device or process that converts AC power to DC power. As such, in some embodiments the rectifier may be configured as part of another device rather than a separate device, as shown in some of the embodiments disclosed herein.

Each service floor 24*a*, 24*b*, 24*c* may have an associated set of rectifiers, such that rectifiers 82*a*, 84*a*, 86*a*, 88*a* are located on a first floor 24*a*; rectifiers 82*b*, 84*b*, 86*b*, 88*b* are located on the second floor 24*b*; and rectifiers 82*c*, 82*c*, 82*c*,

82*c* are located on the third floor 24*c*, as one non-limiting example. The set of rectifiers on each floor may be provided for redundancy and fault management. Those of ordinary skill in the art will appreciate that although FIG. 4 illustrates three floors, with four rectifiers at each floor, these numbers are not limiting and more or fewer floors may be employed in the power distribution system and more or fewer rectifiers may be used, without departing from the scope of the present disclosure. Moreover, the floors containing rectifiers may not be adjacent to each other, and the rectifiers on each floor may provide enough power to serve multiple floors.

The power distribution system 76 may be configured with multiple DC buses per group of lanes 30, 32, 34. As one example, four DC buses 90, 92, 94, 96 may be provided per group of lanes 30, 32, 34. The first bus 90 may be electrically connected to rectifiers 82*a*, 82*b*, 82*c* and runs the length of the lanes 30, 32, 34. The second bus 92 may be electrically connected to rectifiers 84*a*, 84*b*, 84*c* and may run the length of the lanes 30, 32, 34. The third bus 94 may be electrically connected to rectifiers 86*a*, 86*b*, 86*c* and may run the length of the lanes 30, 32, 34. The fourth bus 96 may be electrically connected to rectifiers 88*a*, 88*b*, 88*c* and may run the length of the lanes 30, 32, 34. Thus, the buses 90, 92, 94, 96 may be configured as uninterrupted cables, wires, or power lines that provide a continuous power feed for the length of each lane 30, 32, 34.

Those of ordinary skill in the art will appreciate that the number of buses is variable, adjustable, or changeable, but typically the number of buses would need to be greater than one for adequate fault management and redundancy. To energize each DC bus 90, 92, 94, 96, an associated rectifier or group of rectifiers (as described above) may be applied. Moreover, energy storages or batteries 100*a*, 102*a*, 104*a*, 106*a* may be attached to each respective rectifier 82*a*, 84*a*, 86*a*, 88*a* to provide for example back-up power should the grid 78 fail, or as other emergency and/or excess/additional power source and/or as a power storage medium/location. Moreover, similar battery backups may be provided for the remaining rectifiers as previously described. Each of the DC buses 90, 92, 94, 96 may run along the lanes 30, 32, 34 with various drives 54 connected to the DC bus as previously described.

Depending on the direction of movement of the elevator cars 28 the drives 54 could be either sourcing or sinking power into the DC busses (e.g., if an elevator car 28 is moving downward and braking, power may be sourced and extracted from the system such as to recharge the associated batteries (100*a*, 102*a*, 104*a*, 106*a*, etc.), or if the elevator car 28 is moving upward, power is provided to the associated bus from the grid or from the batteries. The presence of a continuous DC bus enables the power distribution system 76 to easily share power between various elevator cars 28 located in different elevations of the lanes 30, 32, 34. For example, if a first elevator car in a lane is being propelled upward, and if a second elevator car is braking and moving downward, the power gained from regenerative braking of the second elevator car can be redistributed and used to propel or power the first elevator car. In some such embodiments, regenerative power can be transferred from a bus, through a rectifier, into the power line of the system (AC side) then to another rectifier, and into another bus. Further, in some such embodiments, if a first elevator car is traveling upward in a lane and a second elevator car is traveling downward in the same lane, power may not need to travel through the rectifiers, and thus no conversion of AC/DC power is required, providing an additional efficiency to the system. In some embodiments, the various DC buses 90, 92, 94, 96 may have series devices electrically connected thereto to provide disconnect mechanisms in case of a fault, such as circuit breakers, contactors, and others.

The batteries 100*a-c*, 102*a-c*, 104*a-c*, 106*a-c*, may be used to provide power to the elevator system 20 in the event of a power failure from the grid 78 and/or provide power storage or supply for other reasons. The batteries 100*a*, 102*a*, 104*a*, 106*a*, etc. at each service floor, and located with each respective rectifier 82*a*, 84*a*, 86*a*, 88*a*, etc. provides emergency power to the system 76. Further, each battery 100*a*, 102*a*, 104*a*, 106*a*, etc., as noted above, can be recharged through regenerative braking of the elevator cars 28. In the embodiment and configuration, the power from the battery that is configured for one bus may be transmitted through the associated rectifier, back into the power lines 80, and provided to another battery or to another rectifier and/or bus. For example, power may be extracted from battery 100*a*, converted in rectifier 82*a*, conveyed through lines 80 to rectifier 82*b*, and sourced into either battery 100*b* or bus 90. Accordingly, in some embodiments, the rectifiers employed are bi-directional, and can be used to provide energy back to the grid 78 or to other components of the propulsion system 40. Furthermore, in some embodiments, with a continuous bus extending the length of a lane, power can be transferred within that lane. For example, if a first elevator car in a lane is braking and thus generating power, that generated power can be transferred through the bus in which it is generated to another elevator in the same lane, without requiring the power to leave the lane, or even the bus.

The physical sizing of the power distribution system 76 components described above and other components of the propulsion system 40 is dependent upon the maximum power demand, no matter how brief and/or infrequent this maximum power demand may be. The present disclosure facilitates the reduction of component sizes. Component size reduction may reduce costs, reduce and simplify maintenance, improve system packaging opportunities, and other benefits. To assist in reducing component size and cost, and to improve system packaging, the system controller 62 may be pre-programmed to function as a type of power governor eliminating or reducing peak power demands by adjusting how the elevator system 20 operates.

The system controller 62 may include control circuitry such as a computer processor 108 and a computer readable storage medium 110 (see FIG. 3). The storage medium 110 may include hard disk drive storage, nonvolatile memory (e.g., flash memory or other electrically-programmable-read-only memory configured to form a solid state drive), volatile memory (e.g., static or dynamic random-access-memory), and others. The processor 108 may be based on one or more microprocessors, microcontrollers, digital signal processors, baseband processors, power management units, audio codec chips, application specific integrated circuits, and others.

Figure 5:
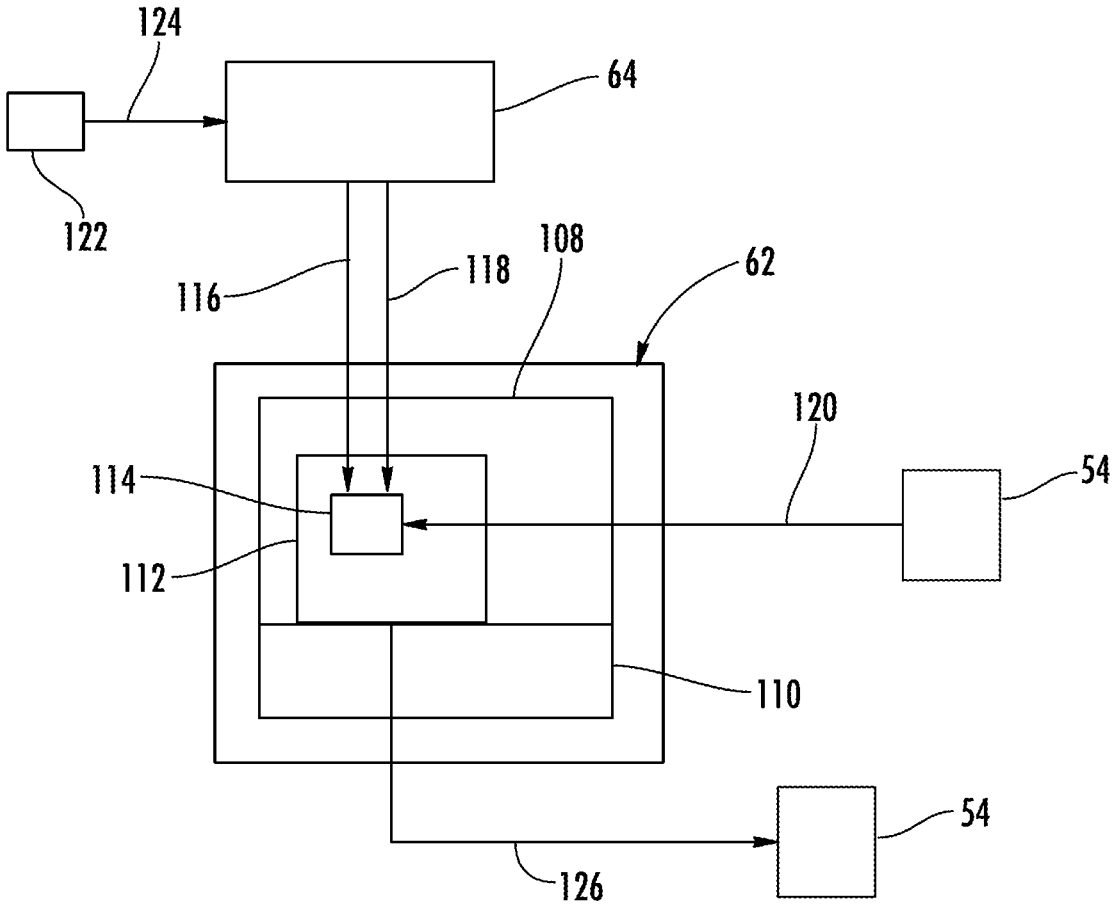
FIG. 5 is a schematic of a system controller of the propulsion system.

Referring to FIGS. 3 and 5, the processor 108 is configured to run a software-based dispatching algorithm 112 that may include a power estimator 114 that may be a sub-routine for power estimation. The power estimator 114 is configured to determine an estimate of the power required to run each individual car 28. To calculate the estimate of power, the power estimator utilizes a real-time weight or load signal (see arrow 116) indicative of the loaded car 28 weight and a run trajectory signal (see arrow 118) indicative of a requested trajectory by, for example, a car occupant. The load signal 116 and the run trajectory signal 118 are used by the power estimator 114 along with a real-time, existing, power draw (see arrow 120) that may be measured at an associated drive 54, as one, non-limiting, example. The load 116 may be measured by a load sensor 122 mounted to the elevator car 28 (also see FIG. 3). The load sensor 122 may output a signal (see arrow 124) to the on-board controller 64 that in-turn outputs the load 116 (i.e., as a signal) to the system controller 62 by, for example, a wireless pathway. The load 116 may be representative of the cargo and/or total occupant weight for a given run trajectory 118. The run trajectory 118 is representative of the next car run command initiated by any one of the car occupants. It is further contemplated and understood that the calculation of the power estimate may also rely on an estimate of future loads based on the number of occupants assigned to the elevator car 28 during a run trajectory. The load estimation may also be relevant for planning purposes when deciding which elevator car 28 is assigned to the occupants.

The power estimate calculated by the power estimator 114 may then be compared to a pre-programmed maximum power allowance by the processor 112. If the power estimate does not exceed the maximum power allowance, operation of the elevator system 20 as a result of a particular elevator car run trajectory need not be governed. If the power estimate exceeds the maximum power allowance, the processor 114 of the system controller 62 may initiate an automated, power governing, command signal 126 to, for example, selected drives 54 associated with respective motor modules 56.

Figure 6:
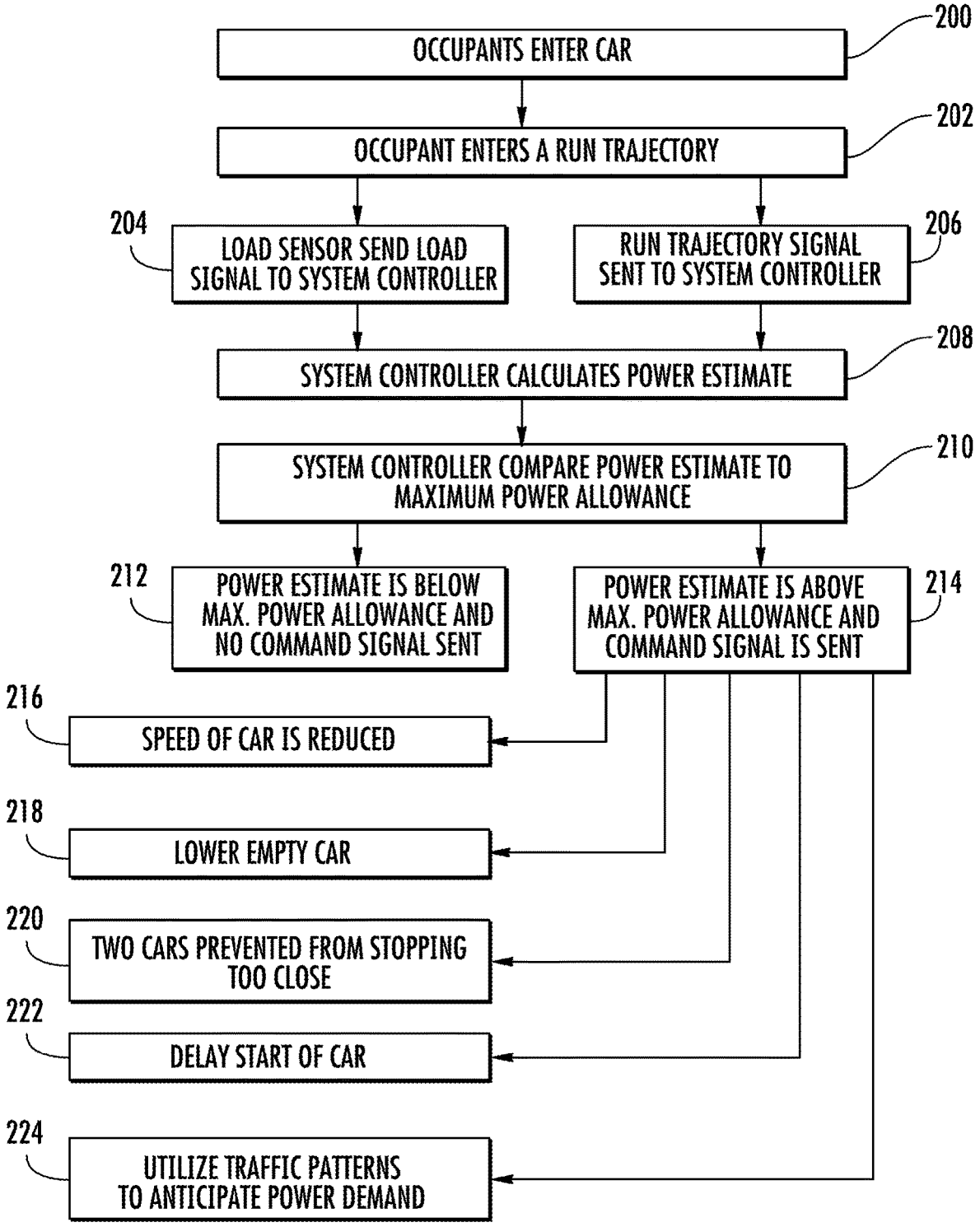
FIG. 6 is a block diagram of a method of operating the propulsion system.

Referring to FIG. 6 a block diagram is illustrated generally detailing a non-limiting example of a portion of the elevator control system 40 operation that governs power distribution. In block 200, occupants may enter one of a plurality of elevator cars 28 that may generally be distributed amongst a plurality of lanes 30, 32, 34. In block 202, one of the occupants may enter a run trajectory (e.g., traveling from a building lobby to floor eleven). This entry may also be accomplished by the occupant prior to entering the elevator car 28. Upon entering of the requested run trajectory, the load sensor 122 may initiate the load signal 116 sent to the system controller 62 (see block 204). Also upon occupant selection of a run trajectory, the run trajectory signal 118 may be sent to the system controller 62 (see block 206).

As block 208, the system controller 62 may apply the power estimator of the dispatching algorithm to calculate a power estimate utilizing the load signal 116, the run trajectory signal 118 and the current power draw for the particular elevator car 28. The controller 62 may then compare the power estimate to the maximum power allowance (see block 210), and may compare the power demands to other elevator cars 28 in the system 20. If the power estimate is below the maximum power allowance, the controller will not output a power governing command signal 126 (see block 212). If the power estimate is above the maximum power allowance, the system controller 62 may send a power governing command signal 126 to, for example, the selected drives 54 (see block 214).

The power governing command signal 126 may be any command that prevents exceeding maximum power allowance and provide the least amount of disruption amongst what may be a plurality of cars 28 traveling in what may be a plurality of lanes 30, 32, 34. For example and as block 216, the command signal 126 may reduce the speed of the car 28 identified with the run trajectory at issue. As block 218, the command signal 126 may cause a second elevator car 28 that may be determined to be empty of occupants via load sensor 122 to lower thereby recovering system power through regeneration as previously described. The lowering elevator car 28 may be in any lane and not necessarily the same lane as the car with the run trajectory at issue. As block 220, the command signal 126 may prevent two elevator cars from stopping to close to one-another, thereby preventing two cars from being on the same power circuit (e.g., same motor module 56, or the same power line serving multiple motor modules, etc.). As block 222, the command signal 126 may simply delay the run trajectory start of the elevator car 28, and/or may delay the start of other cars that may preferably be empty. As block 224, the system controller 62 may utilize traffic patterns (e.g., up-peak, down-peak, normal) and anticipate power demand and power demand distribution by placing cars so demand is not concentrated in time and space. It is further contemplated and understood that the present disclosure may further apply to other building equipment and/or utilities that may cycle on and off (e.g., heating and cooling systems).

It is further contemplated and understood, that any one or more command signals may be sent at any one time or in any order to govern power. For example, the command signal may slow the speed of the elevator car associated with the run trajectory, and/or another command signal may slow the speed down of at least one other elevator car of a plurality of elevator cars not directly associated with the run trajectory at issue. It is further understood that the type of command signal may be dependent upon the particular power distribution system and not necessarily the specific system 76 described above. Any one type of command signal may be sent to any one or more cars in one or more lanes. Yet further, the maximum power allowance may be the maximum power allowance for each individual motor module 56, an entire propulsion system 40, or generally any other sub-groups there-between. It is further understood that traits of the system 76 may be implemented for a screw-motor-based propulsion system and not just for linear motor systems.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A method of governing elevator power comprising:

calculating a power estimate for the elevator car by the electronic processor based on a run trajectory;

comparing the power estimate to a pre-programmed maximum power allowance;

initializing an automated action by the electronic processor if the power estimate exceeds the maximum power allowance; and inputting an elevator car weight for calculating the power estimate, wherein the maximum power allowance is on a per motor module basis and the automated action comprises preventing a plurality of cars from stopping too closely thereby positioning the plurality of cars on different motor modules.

2. A method of governing elevator power comprising:

calculating a power estimate for the elevator car by the electronic processor based on a run trajectory;

comparing the power estimate to a pre-programmed maximum power allowance;

initializing an automated action by the electronic processor if the power estimate exceeds the maximum power allowance;

inputting an elevator car weight for calculating the power estimate;

establishing traffic patterns in time and space; and utilizing the traffic patterns to anticipate power demand distribution, and wherein the automated action comprises placing the car so power demand is not concentrated in time and space.

3. A method of governing elevator power comprising:

calculating a power estimate for the elevator car by the electronic processor based on a run trajectory;

comparing the power estimate to a pre-programmed maximum power allowance;

initializing an automated action by the electronic processor if the power estimate exceeds the maximum power allowance;

inputting an elevator car weight for calculating the power estimate;

entry of the run trajectory by an occupant; and allocating the occupant to a specific elevator car of a plurality of elevator cars based on the run trajectory and the power estimate for each one of the plurality of elevator cars.

4. A ropeless elevator system comprising:

a first elevator car constructed and arranged to move in a first lane;

a first plurality of motor modules distributed along the first lane and constructed and arranged to propel the first elevator car;

an electronic processor configured to selectively control power delivered to each one of the first plurality of motor modules, the electronic processor including a software-based power estimator configured to receive a weight signal and a run trajectory signal for calculating a power estimate and comparing the power estimate to a maximum power allowance, and wherein the electronic processor is configured to output an automated command signal if the power estimate exceeds the maximum power allowance; and a second elevator car configured to be controlled by the automated command signal, wherein the second elevator car is located in the first lane and propelled by the first plurality of motor modules, and the automated command signal is selectively outputted to the first plurality of motor modules for preventing the first and second elevator cars from stopping too closely thereby positioning the first and second elevator cars at different modules of the first plurality of modules.

* * * * *